US010651587B2

(12) United States Patent
Wu et al.

(10) Patent No.: US 10,651,587 B2
(45) Date of Patent: May 12, 2020

(54) AUTOMATIC EJECTION MECHANISM OF CONNECTING DEVICE

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Ze-Min Wu, Shenzhen (CN); Zhan-Sheng Lu, Shenzhen (CN); Yu-Chun Sun, New Taipei (TW)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/112,620

(22) Filed: Aug. 24, 2018

(65) Prior Publication Data

US 2019/0363477 A1 Nov. 28, 2019

(30) Foreign Application Priority Data

May 28, 2018 (CN) ..... 2018 1 0523530

(51) Int. Cl.
*H01R 13/44* (2006.01)
*H01R 13/502* (2006.01)
*H01R 12/72* (2011.01)

(52) U.S. Cl.
CPC ..... *H01R 13/44* (2013.01); *H01R 12/722* (2013.01); *H01R 13/5025* (2013.01)

(58) Field of Classification Search
CPC ..... H01R 13/60; H01R 13/635; H01R 13/44; H01R 13/52; H01R 13/62; H01R 2201/06; G06F 1/1656; G06F 1/181; G06F 1/187
See application file for complete search history.

(56) References Cited

U.S. PATENT DOCUMENTS 6,527,566 B1 * 3/2003 Lambiaso ..... H02G 11/00 439/131
7,309,245 B2 * 12/2007 Sadatoku ..... H01R 13/635 439/159
7,670,160 B2 * 3/2010 Tsuji ..... G06K 7/0021 439/159

(Continued)

FOREIGN PATENT DOCUMENTS

TW M383764 U1 7/2010
TW M419378 U1 12/2011

*Primary Examiner* — Edwin A. Leon
*Assistant Examiner* — Matthew T Dzierzynski
(74) *Attorney, Agent, or Firm* — ScienBiziP, P.C.

(57) ABSTRACT

An automatic ejection mechanism of a connecting device includes an outer shell defining an accommodating space and including a rear cover covering a rear end of the accommodating space, a connector slidably received within the accommodating space, a fastening assembly located between the connector and the rear cover, and a resilient member located between the connector and the rear cover. The resilient member drives the connector to slide toward an opening of a front end of the accommodating space. The connector is received within the accommodating space by being fastened to the connector. The connector is ejected out of the opening of the front end by releasing the fastener from the connector.

9 Claims, 5 Drawing Sheets

(56) References Cited

U.S. PATENT DOCUMENTS

| | | | | |
|---|---|---|---|---|
| 7,787,243 | B2 * | 8/2010 | Salazar | H05K 5/0278 361/679.31 |
| 7,811,102 | B2 * | 10/2010 | Lai | G06F 1/1616 361/679.55 |
| 8,272,884 | B2 * | 9/2012 | Lin | H04M 1/0227 439/131 |
| 8,274,786 | B2 * | 9/2012 | Sapper | G06F 1/1656 361/679.02 |
| 8,292,641 | B2 * | 10/2012 | Kim | G06K 19/07732 439/135 |
| 8,325,239 | B2 * | 12/2012 | Kaplan | H04N 5/2252 348/207.1 |
| 8,545,242 | B2 * | 10/2013 | Zhang | H01R 13/52 439/131 |
| 8,562,363 | B2 * | 10/2013 | Kikuchi | H01R 13/635 439/157 |
| 8,657,610 | B2 * | 2/2014 | Lee | H01R 35/04 439/131 |
| 9,184,536 | B2 * | 11/2015 | Senatori | G06F 1/1656 |
| 9,395,768 | B2 * | 7/2016 | Huang | H05K 5/0278 |
| 9,444,181 | B2 * | 9/2016 | Ishihara | H01R 13/60 |
| 9,612,630 | B2 * | 4/2017 | Lin | G06F 1/181 |
| 9,859,653 | B2 * | 1/2018 | Motohashi | H01R 13/635 |
| 2006/0211283 | A1 * | 9/2006 | Weng | H01R 27/00 439/131 |
| 2009/0197443 | A1 * | 8/2009 | Wei | H01R 13/60 439/131 |
| 2009/0323269 | A1 * | 12/2009 | Iwata | G06F 1/162 361/679.09 |
| 2011/0216491 | A1 | 9/2011 | Lian et al. | |

* cited by examiner

AUTOMATIC EJECTION MECHANISM OF CONNECTING DEVICE

FIELD

The subject matter herein generally relates to connecting devices, and more particularly to an automatic ejection mechanism of a connecting device.

BACKGROUND

Electronic devices are a part of daily life. In general, electronic devices have input/output connectors (I/O connectors) for connecting to external devices. The I/O connectors are usually fixed on an outer shell of the electronic device, which may affect an outer appearance of the electronic device.

Therefore, there is room for improvement within the art.

BRIEF DESCRIPTION OF THE DRAWINGS

Implementations of the present disclosure will now be described, by way of example only, with reference to the attached figures.

DETAILED DESCRIPTION

Figure 1:
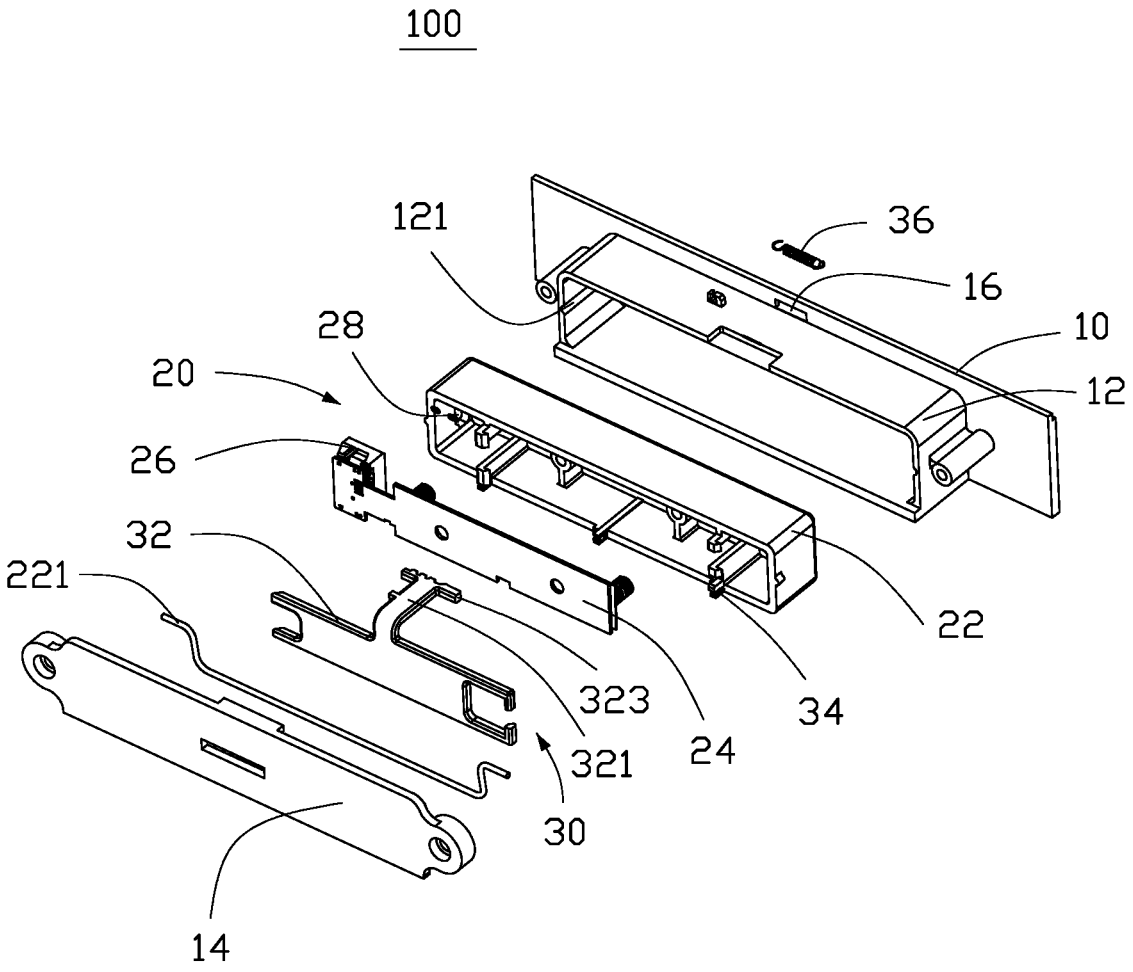
FIG. 1 is an exploded, isometric view of an embodiment of an automatic ejection mechanism of a connecting device in accordance with an embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series and the like.

FIG. 1 illustrates an embodiment of an automatic ejection mechanism 100 of a connecting device. The automatic ejection mechanism 100 includes an outer shell 10, a connector 20, and a fastening assembly 30. The outer shell 10 defines an accommodating space 12 and includes a rear cover 14. The connector 20 is slidably received within the accommodating space 12. The rear cover 14 covers a rear end of the accommodating space 12. The fastening assembly 30 and a resilient member 40 are located between the rear cover 14 and the connector 20 (shown in FIG. 2). The resilient member 40 is located on the rear cover 14 corresponds to the connector 20 through the fastening assembly 30. The resilient member 40 is compressed by the rear cover 14 covering the rear end of the accommodating space 12, and a force of the resilient member 40 is applied on the connector 20 to drive the connector 20 to slide out of an opening of a front end of the accommodating space 12. The connector 20 is fastened to the fastening assembly 30 and received within the accommodating space 12. In addition, when the fastening assembly 30 releases the connector 20, the connector 20 is ejected out of the opening of the front end of the accommodating space 12 to protrude out of the outer shell 10. In detail, the connector 20 is slidably received within the accommodating space 12, and the fastening assembly 30 and the resilient member 40 are located between the rear cover 14 and the connector 20. Therefore, by utilizing the connector 20 fastened to the fastening assembly 30 and a force of the resilient member 40, the connector 20 is received in, or ejected out of, the outer shell 10. In at least one embodiment, the outer shell 10 defines a limiting groove 121 in opposite inner walls of the accommodating space 12. The limiting groove 121 extends to the rear end of the accommodating space 12. Thus, the connector 20 is slidably received in the limiting grooves 121. Furthermore, the connector 20 includes a base 22 and a circuit board 24. A front end of the base 22 is covered and faces an opening of a front end of the accommodating space 12. The circuit board 24 is located within the base 22 and faces the fastening assembly 30 through an opening of a rear end of the base 22. The circuit board 24 includes a connector socket 26 positioned in front of a connector opening 28 of a side of the base 22. In addition, the fastening assembly 30 includes a buckle 32 and a pair of hook clasps 34. The hook clasps 34 are located within the base 22 of the connector 20 and extend toward the opening of the rear end of the base 22. The buckle 32 is located in the opening of the rear end of the base 22, and two ends of the buckle 32 correspond to the hook clasps 34.

Figure 2:
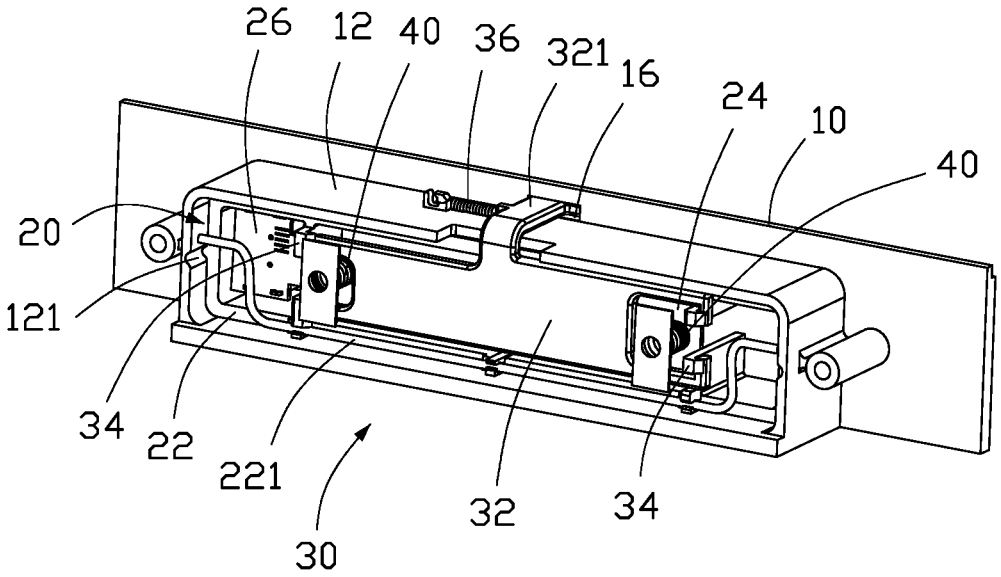
FIG. 2 is an assembled, isometric rear view of the automatic ejection mechanism in FIG. 1 showing a connector clasped to a fastening assembly.

Referring to FIG. 2, the connector 20 is received within the sliding grooves 121 of the accommodating space 12 through the base 22. The pair of hook clasps 34 clasp the two ends of the buckle 32 on the base 22 so that the connector 20 is received within the accommodating space 12 of the outer shell 10. In addition, the buckle 32 of the fastening assembly 30 includes a lever 321. A first end of the lever 321 is fixed to an upper periphery of the buckle 32. A second end of the lever 321 extends beyond an outer surface of the accommodating space 12 toward an outer surface of the housing 10.

An extension spring 36 is located between the lever 321 and the outer surface of the accommodating space 12. A force of the extension spring 36 causes the buckle 32 to be in a clasping position with the hook clasps 34. In other words, the force of the extension spring 36 maintains the connector 20 to be received within the accommodating space 12 of the outer shell 10 and maintains the buckle 32 to be in the clasping position with the hook clasps 34. The force of the resilient member 40 is applied on the connector 20, and the fastening assembly 30 fastens the connector 20 within the accommodating space 12.

Figure 3:
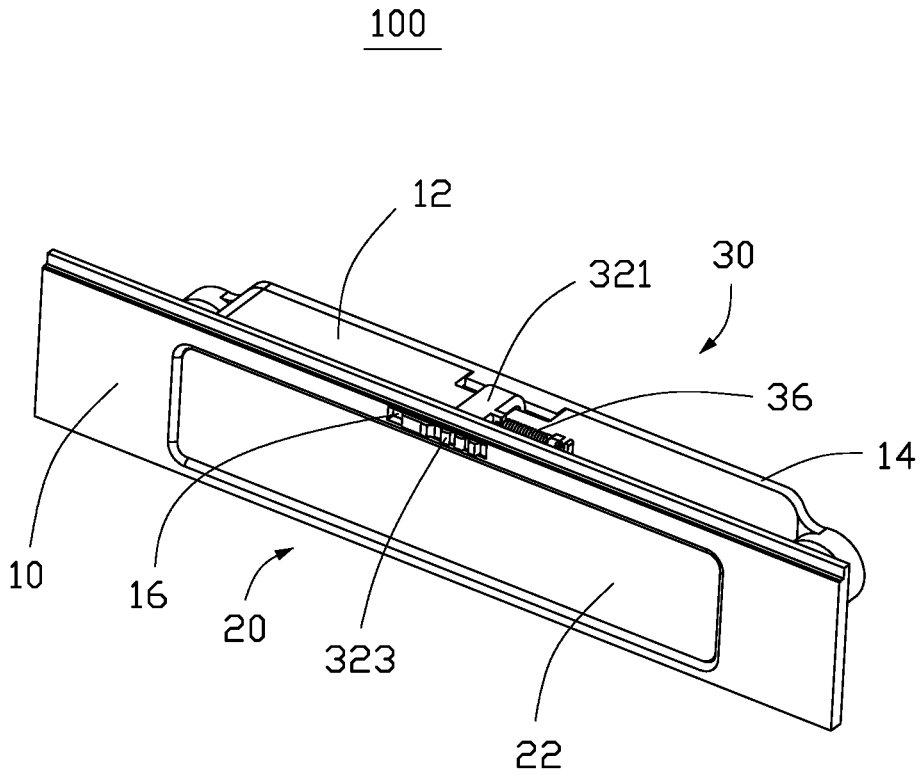
FIG. 3 is an assembled, isometric front view of the automatic ejection mechanism in FIG. 2.

Referring to FIG. 3, when the connector 20 is received within the accommodating space 12 of the outer shell 10, the covered front end of the base 22 of the connector 20 is flush with the opening of the front end of the accommodating space 12, so that an outer appearance of the outer shell 10 is clean. The lever 321 includes a releasing toggle 323 located on the second end of the lever 321. A limiting hole 16 is defined in an outer surface of the outer shell 10, and the lever 321 extends through the limiting hole 16 so that the releasing toggle 323 is located on the outer surface of the outer shell 10. The releasing toggle 323 is operable to drive the buckle 32 coupled to the lever 321. The limiting hole 16 limits movement of the lever 321. As illustrated in FIG. 2, the buckle 32 clasped with the hook clasps 34 is achieved by the lever 321 limited within the limiting hole 16. In other words, when the extension spring 36 of the lever 321 is extended, the lever 321 is positioned against a side of the limiting hole 16 to maintain the clasping position of the buckle 32 with the hook clasps 34.

Figure 4:
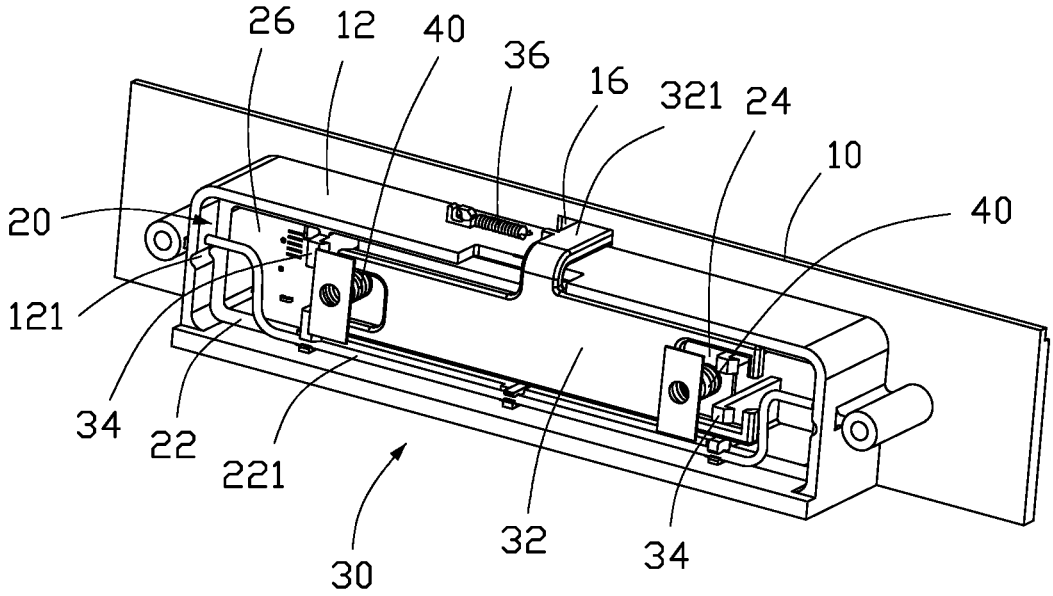
FIG. 4 is an assembled, isometric rear view of the automatic ejection mechanism in FIG. 1 showing the connector released from the fastening assembly.

Referring to FIG. 4, the connector 20 is released from the fastening assembly 30 by operating the lever 321 to drive the buckle 32. In detail, the releasing toggle 323 (shown in FIG. 3) is operated to move a position of the lever 321. When the lever 321 is moved by the releasing toggle 323, the lever 321 moves the buckle 32 to release from the hook clasps 34. When the buckle 32 is released from the hook clasps 34, the resilient member 40 applies force on the connector 20 to eject the connector 20 through the opening of the front end of the accommodating space 12 of the housing 10. The connector 20 is limited to move within the limiting grooves 121. The limiting grooves 121 are covered by the front end of the accommodating space 12 (not shown), so that when the connector 20 is ejected out of the accommodating space 12, the connector is not completely ejected out of the accommodating space 12. In detail, the connector 20 ejected toward the front end of the outer shell 10 is not completely ejected out of the outer shell 10 because the covered front end of the limiting grooves 121 prevents the connector 20 from completely ejecting out of the outer shell 10. Furthermore, the base 22 of the connector 20 includes a balancing bar 221. The balancing bar 221 extends along a bottom periphery of the opening of the rear end of the base 22, and two ends of the balancing bar 221 are pivotably coupled to corresponding opposite inner walls of the accommodating space 12. Therefore, the balancing bar 221 pivotably coupled to the base 22 stabilizes movement of the connector 20 within the accommodating space 12.

Figure 5:
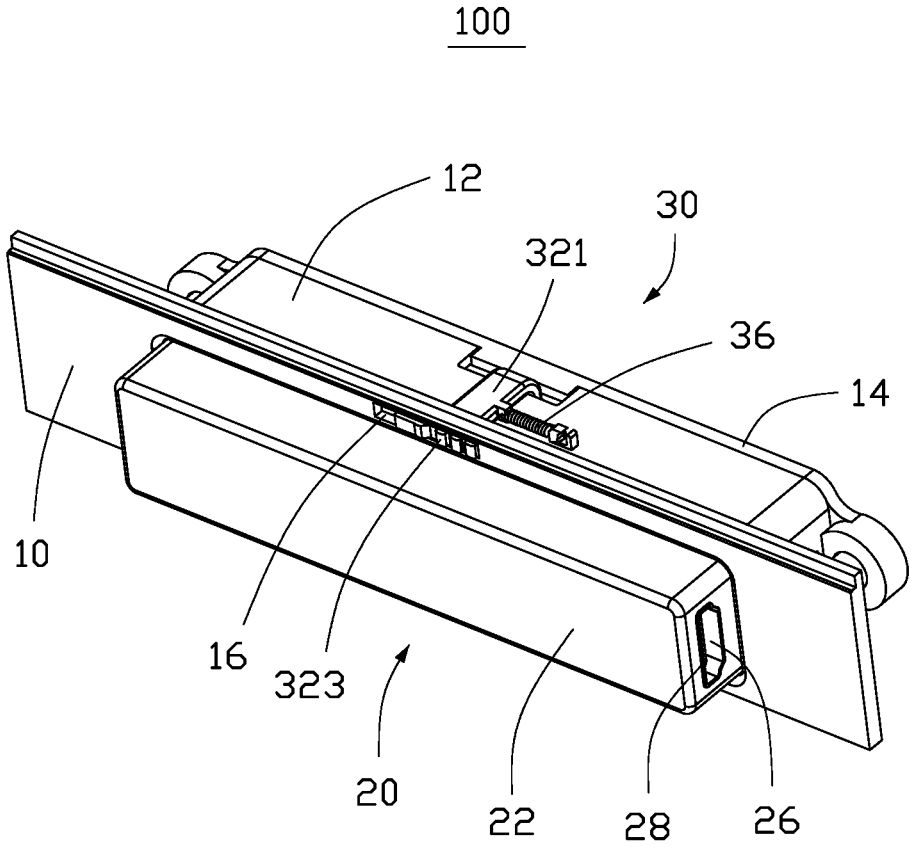
FIG. 5 is an isometric view of the connector ejected out of a housing of the automatic ejection mechanism in FIG. 4.

Referring to FIG. 5, when the connector 20 is ejected out of the outer shell 10, the connector opening 28 of the connector 20 is exposed out of the outer shell 10, and the connector socket 26 is correspondingly exposed out of the outer shell 10. Thus, the connector socket 26 of the connector opening 28 is positioned on a side of the base 22 to provide a connection interface to another connector (not shown). By using the connection socket 26 on the side of the base 22, the connection socket 26 does not need to be located on the front end or the rear end of the base 22, thereby preventing damage to the socket by the force applied by the resilient member 40. Thus, the connector socket 26 located on the side of the base 22 has a more stable and reliable connection. In addition, after the connector 20 is ejected out of the outer shell 10, the lever 321 is automatically driven by the extension spring 36 to return the buckle 32 back to the clasping position with the hook clasps 34, and the limiting hole 16 maintains the clasping position of the buckle 32. When the connector 20 needs to be received back within the accommodating space 12, the connector 20 is pushed to cause the base 22 to retract within the accommodating space 12. After the hook clasps 34 are clasped with the buckle 32 (shown in FIG. 2), the connector 20 is received within the accommodating space 12. Thus, ejection of the connector 20 out of the accommodating space 12 and reception of the connector 20 within the accommodating space 12 is simple, and the outer appearance of the outer shell 10 with the connector 20 received therein is a clean design.

The fastening assembly 30 slidably clasped with the connector 20 controls the connector 20 to automatically eject out of the outer housing 10. Thus, use of the automatic ejection mechanism 100 is simple and safe.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An automatic ejection mechanism of a connecting device, the automatic ejection mechanism comprising:

an outer shell defining an accommodating space and comprising a rear cover covering a rear end of the accommodating space;

a connector slidably received within the accommodating space;

a fastening assembly located between the connector and the rear cover; and a resilient member located between the connector and the rear cover;

wherein the resilient member drives the connector to slide toward an opening of a front end of the accommodating space;

wherein the connector is received within the accommodating space by being fastened to the fastening assembly; and wherein the connector is ejected out of the opening of the front end by releasing the fastening assembly from the connector;

wherein the connector comprises a base and a circuit board; a front end of the base is covered and faces the opening of the front end of the accommodating space; the circuit board is located within the base and faces the fastening assembly through an opening of a rear end of the base; the circuit board comprises a connector socket positioned in front of a connector opening defined in a side of the base; the connector opening is exposed outside of the outer shell when the connector is ejected out of the front end of the accommodating space.

2. The automatic ejection mechanism of claim 1, wherein the outer shell defines a limiting groove in opposite inner walls of the accommodating space; the limiting groove extends to the rear end of the accommodating space and is covered by the front end of the accommodating space so that the connector, when ejected out of the opening of the front end, is not completely ejected out of the accommodating space.

3. The automatic ejection mechanism of claim 1 wherein the base comprises a balancing bar; the balancing bar extends along a bottom periphery of the opening of the rear end of the base; two ends of the balancing bar are pivotably coupled to opposite inner walls of the accommodating space; the balancing bar stabilizes movement of the base within the accommodating space.

4. The automatic ejection mechanism of claim 3, wherein the fastening assembly comprises a buckle and a pair of hook clasps; the hook clasps are located within the base and extend toward the opening of the rear end of the base; the buckle is located in the opening of the rear end of the base; two ends of the buckle correspond to the pair of hook clasps; the two ends of the buckle clasped to the hook clasps causes the connector to be received within the accommodating space of the outer shell.

5. The automatic ejection mechanism of claim 4, wherein the buckle comprises a lever; a first end of the lever is fixed to an upper periphery of the buckle; a second end of the lever extends beyond an outer surface of the accommodating space toward an outer surface of the housing; the lever clasps the buckle to the hook clasps.

6. The automatic ejection mechanism of claim 5, wherein the lever comprises an extension spring between the lever and the outer surface of the accommodating space; a retraction force of the extension spring causes the buckle to be in a clasping position with the hook clasps.

7. The automatic ejection mechanism of claim 5, wherein the lever comprises a releasing toggle located on the second end of the lever; the releasing toggle releases the buckle from the hook clasps.

8. The automatic ejection mechanism of claim 5, wherein the outer surface of the housing defines a limiting hole; the lever extends through the limiting hole; the limiting hole limits movement of the lever to cause the buckle to be positioned in the clasping position with the hook clasps.

9. The automatic ejection mechanism of claim 1, wherein the resilient member is located on the rear cover; the resilient member corresponds to the connector through the fastening assembly; the rear cover covers the rear end of the accommodating space so that the resilient member exerts force on the connector.

* * * * *